US008464733B2

(12) United States Patent
Franklin et al.

(10) Patent No.: US 8,464,733 B2
(45) Date of Patent: Jun. 18, 2013

(54) ORIGINAL EYELASH BUTTERFLY GUARD

(75) Inventors: Natalia Franklin, West Palm Beach, FL (US); Nikolai A. Yakimov, West Palm Beach, FL (US)

(73) Assignee: Holistic Beauty Solutions, LLC., West Palm Beach, FL (US)

( * ) Notice: Subject to any disclaimer, the term of this patent is extended or adjusted under 35 U.S.C. 154(b) by 674 days.

(21) Appl. No.: 12/507,087

(22) Filed: Jul. 22, 2009

(65) Prior Publication Data

US 2010/0018545 A1 Jan. 28, 2010

Related U.S. Application Data

(63) Continuation of application No. 29/336,818, filed on May 9, 2009, now Pat. No. Des. 639,503, which is a continuation of application No. 29/320,559, filed on Jul. 22, 2008, now abandoned.

(51) Int. Cl.
*A45D 40/30* (2006.01)

(52) U.S. Cl.
USPC ..... 132/319

(58) Field of Classification Search
USPC ..... 132/319, 216, 218, 320, 285; 2/206, 2/173, 9; 128/201.13
See application file for complete search history.

(56) References Cited

U.S. PATENT DOCUMENTS

| | | | | |
|---|---|---|---|---|
| 1,291,846 | A * | 1/1919 | Greenfield | 2/206 |
| 4,014,047 | A * | 3/1977 | Zobel | 128/206.19 |
| 4,807,650 | A * | 2/1989 | Bliss | 132/319 |
| 5,007,114 | A * | 4/1991 | Numano | 2/206 |
| 5,186,190 | A * | 2/1993 | Hirzel | 132/319 |
| 7,219,674 | B1 * | 5/2007 | Shelley | 132/319 |
| 2004/0231694 | A1 * | 11/2004 | Rosenblatt | 132/319 |

* cited by examiner

*Primary Examiner* — Todd Manahan
*Assistant Examiner* — Brianne Kalach

(57) ABSTRACT

The original butterfly eyelash guard use in the cosmetic field as a skin, eyes, and eyelash disposable shield in the application of eye makeup and/or as a protector during eye makeup removal, eyelash tinting, artificial eyelash extension, permanent makeup tattooing. The eyelash guard molds firmly around the bridge of the nose, fits perfectly under any size of eyes, and secures to both sides of the face, thereby freeing the hands to apply makeup or to perform other procedures as described. Also, it can be used over eyelids. The eyelash guard is for everyone who wants to look the best, raise job standards and bring enjoyment to the makeup application routine. The original butterfly eyelash guard is for everyone who wants to save a lot of time, money and have a tool that may help to prevent premature aging and damage to eyelashes and skin.

2 Claims, 2 Drawing Sheets

1AC
2
2AC
1
3
d
e
A
1A
4
5
6
B
2B
1B
C
1C
2C
3C

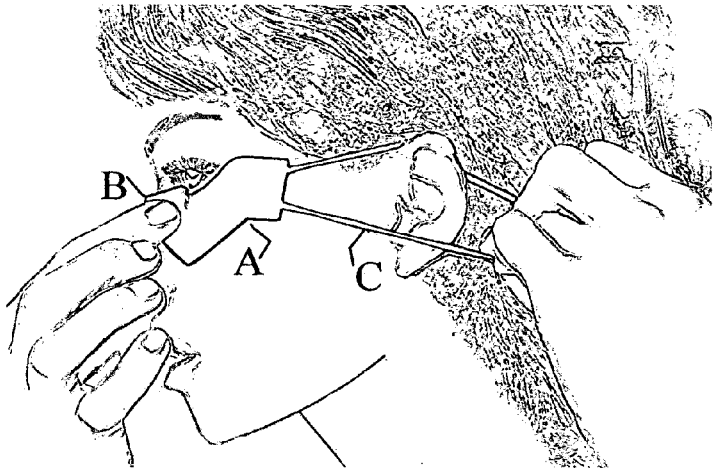
FIG.5
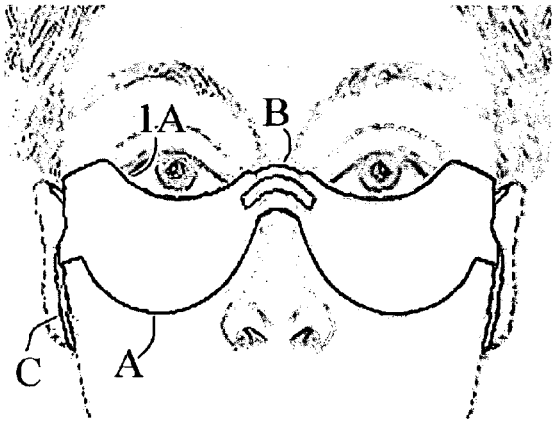
FIG.6
FIG.7
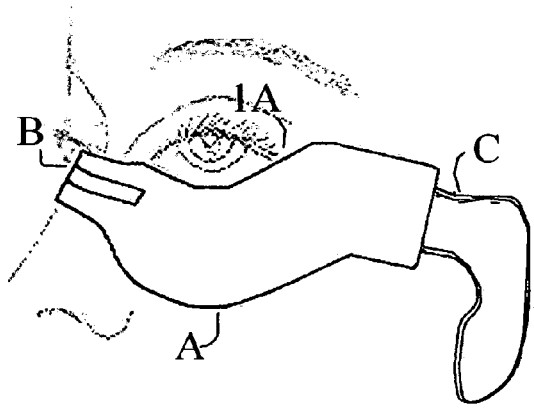

ORIGINAL EYELASH BUTTERFLY GUARD

FIELD AND BACKGROUND OF THE INVENTION

The embodiment of the present invention of the eyelash guard relates to disposable eye makeup shields for use in the cosmetic field as a skin, eyes, and eyelash protector from excess eye makeup falling thereon during application.

The area around the eyes is critical in the field of any cosmetic manipulations. The application of eye makeup is the most difficult, complex and lengthy part of all beautifying procedures. That is why the application of mascara on eyelashes, and eye shadows on eyelids, never can be perfect without the use of a protective shield behind the eyelashes. Such misapplication causes a user to appear old and tired from eye makeup smears. A mirror with small magnification reveals that small drops of mascara and eye shadow's powder disperse under eyes, on the nose bridge and on the cheekbone area. Such dispersal can be perceived as dark clogged pores. An attempt to remove eye makeup smudges, results in unattractive shadows under the eyes and/or eye or skin irritation. In addition, it ruins the consuming and meticulous work of a camouflage of dark circles and bags under the eyes by skin tone facial makeup. Specifically, every cosmetic specialist knows that the breakage of a layer made by a concealer, foundation, and dry powder is impossible to patch. The user must spend precious time to remove makeup and reapply it again to achieve excellent results. The follow-on stress, frustration and anxiety rob precious time.

During the eyelash tinting procedure, when permanent black dye is applied on eyelashes, and eyelashes are pressed to the skin without the support behind eyelashes, permanent discoloration of the skin occurs. As a result, the recipient needs to wait for a week until the damaged epidermis sheds and new and clean skin cells grow.

During an eye makeup removal procedure, the eyelashes must be cleaned by pressing them against the skin resulting in residual black mascara rubbing off around the eye area, and as a result, requires more cleaning. It is a well-known fact that daily application of harsh chemicals, such as alkaline soaps or mascara removal solutions, on unprotected delicate and sensitive skin around eyes may cause the irritation of the eyes and eyelids, skin damage, premature aging, wrinkles, dryness, pigmentation and loss of eyelashes. The skin pigmentation may also be caused by micro makeup particles of black or dark shades of the eye makeup penetrating into the dermis; these problems can be avoided with the protective shield such as the eyelash guard.

Several different devices have been proposed to assist in the application and/or removal of eye makeup. For example, U.S. Pat. No. 6,640,814 issued to Burke; U.S. Pat. No. 5,957,142 issued to Karafilis; U.S. Pat. No. 5,178,170 issued to Kassai; U.S. Pat. No. 5,016,658 issued to Green; U.S. Pat. No. 2004/0255971 issued to Houghton; U.S. Pat. No. D536,129 issued to Davis; U.S. Pat. No. 3,884,232 issued to Braun. All of these plastic handheld mascara protectors are supposed to be held under the angle to the eye. However, they can slide from hands and damage the eye. The coverage of those devices is too small and too smooth to protect the skin from falling eye shadow's fine powder. Such tools that feature smooth plastic surfacing, allow mascara to permeate beneath the device, or it sticks to the skin, breaking the under-eye makeup coverage. All these devices are made for use in very limited applications. It is impossible to use handhold shields during eyelash extension procedures, eyelash tinting or permanent makeup tattooing, where a specialist must use both hands. These devices are not made for use in public facilities because they are not disposable and are not able to have a proper sterilization.

Other type of protective shields are made from paper or fabric. For example, U.S. Pat. No. D533,302 issued to Luciano; U.S. Pat. No. D461,278 issued to Takechi; U.S. Pat. No. 5,050,624 issued to Kobe; U.S. Pat. No. 1,850,540 issued to Erickson. The coverage of these devices is too small and requires a lot of hand holding. All of these devices are made for use in limited applications.

Some eye makeup protectors on the market today have adhesive materials positioned directly under the eyes to hold them in place, for example U.S. 20090151744 A1 by Villanueva is of this type. This area, directly under the eyes, is precisely where the face has its most delicate and thinnest skin. Repeated use of any kind of adhesive materials on this kind of skin causes excessive skin exfoliation and skin irritation. Moreover, stickers will break the previously placed makeup coverage that was under the eyes.

The following devices are not invented to protect around the eye area. For example, U.S. Pat. No. D499,509 issued to Hiroi; U.S. Pat. No. D426,019 issued to Acki; U.S. Pat. No. D487,942 issued to Hiroi; U.S. Pat. No. D423,712 issued to Acki. These are gauze facial mask sheets to use for skin treatments as compresses saturated in skin care products: cream-masks, lotions, serums and paraffin applications.

Following devices are not invented to protect around the eye area. For example, U.S 20040231694 A1 by Rosenblatt; U.S. Pat. No. 5,186,190 Hirzel; JP No. 07-209068 A by Kokuni; KR 10-2007-0025158 A by Kim; KR 20-0294053 Y1 by Tarae International Co, LTD. These are perforated eyebrow applicator templates intended for simulated eyebrow application. They are not proposed for protection of the skin from smears during application of eye makeup (mascara, eye shadow) on eyelashes and/or lower eyelids. The eyebrow templates are unable to mold tightly under eyelashes to maximize closeness to the roots of the eyelashes and the precise lining over the skin under eyelashes. The middle part of the eyebrow templates have been cut far over the nose bridge, making it impossible to incorporate the metal element within these devices to enable it to firmly settle over the nose bridge, as the eyelash guard does. In addition, the design features of the eyelash guard allows it to be adjusted to the any size, shape and position of the eyes; to be used as a mechanism that enables bringing the device precisely dose to the roots of eyelashes; and as a fastening element. Eyebrow templates are not designed to utilize all these features. In addition, the securing mechanism of eyebrow applicator templates is an elastic headband, whereas the eyelash guard fastens to the user's face by two elastic ear loops, conforming to the user's ears.

SUMMARY OF THE INVENTION

The embodiment of the eyelash guard device invention is directed to the eye makeup protective shield that overcomes difficulties of prior art (devices) by providing a hands-free-use device that eliminates eye makeup smudges. The said device features a strip of material, which is curved to conform to the natural shape of the lower eyelids and to fit precisely to the natural curvatures of the face. This design provides precise, wide and fixed coverage of the skin on both sides of the face, from the human eyelash growth line to the beginning of the cheekbone. The device firmly settles on the nose bridge due to a metal element that is integrated in the middle narrowing of the device and works as a size adjuster. The metal element helps to secure the device on the person's face. The method of fastening the device to the user's face is accomplished by two identical elastic ear loops which are connected to the body of the device and that end at the beginning of the temporal area. This type of fastening method would not smash up the user's hairstyle if compared to the headband.

The eyelash guard assists the user to achieve longer and fuller looking eyelashes. It improves and enhances the process for applying mascara to the eyelashes and makes the process enjoyable and stress free. The eyelash guard provides a protective surface against which the mascara brush can operate firmly. The user can apply an appropriate level of force all the way through the eyelashes, which allows for an even and complete mascara application without dumps and smears. This even coat of mascara seals every eyelash and it prevents black sheds and drops on the skin. It is impossible to attain such a result without utilizing a skin protective device.

The eyelash guard shields the delicate skin under eye from the harsh chemicals used during daily eye makeup removal. Upon softly pressing the eyelashes against the body of the eyelash guard, the unit allows for the gentle cleansing of the eyelashes with a cotton swab saturated with eye makeup removal solution all the way through the eyelashes without forceful rubbing. The design of the eyelash guard encourages the diffusion of mascara on cotton swabs and on the protective shield thereby negating mascara diffusion upon the skin. The device may help to prevent eyelashes from falling out and irritation of the eyes and eyelids. In addition, it may help to protect the skin from the pulling and stretching motions associated with unprotected eye makeup removal that contributes to formation of shadows and bags resulting from excessively stretched skin.

Black eyelash extension procedures as well as black mascara enhancements performed upon darkly pigmented users are simplified by the use of the white colored eyelash guard.

The body of the device can be made from non-glossy, substantially absorbent, mascara resistant materials such as paper, some types of fabric, etc. These kinds of materials are semi-porous and are able to hold eye makeup in liquid and powder form and prevent staining of the skin.

The eyelash guard is not made with adhesive materials and does not have a smooth and sticky surface as a fastening mechanism; therefore, when placed directly under the eyes, the eyelash guard does not stick to the skin and does not cause damage to the skin or break the under eye makeup coverage.

The eyelash guard is a very safe device, as it is hands-free when used. Other competing devices are handheld and held on an angle against the eye when applying eye makeup and could cause damage to the eye, if not used properly.

The design of the eyelash guard allows for the much more rapid application and removal of makeup without smears around the eyes, which greatly contributes to the user's productivity both in a home and business environment.

The eyelash guard is disposable, which enhances it's essential and wide ranging appeal to various business users: spas, salons, theatrical, and movie production studios. The eyelash guard can be used in medical facilities given the compelling requirement for medical personnel to protect their patient's eyes, the delicate skin around the eyes and the eyelashes. The deployment of disposable and sterilized eyelash guards can be found helpful during some medical procedures.

BRIEF DESCRIPTION OF THE DRAWINGS

In the drawings:

FIG. 5 is a side view of an eyelash guard on the user's face structured and used in accordance with principles of the present invention;

FIG. 6 is a front view of the eyelash guard on the user's face structured and used in accordance with principles of the present invention;

FIG. 7 is a side view of the eyelash guard as shown in FIG. 6 structured and used in accordance with principles of the present invention.

DETAILED DESCRIPTION OF THE INVENTION

Figures 1, 2, 3, 4:
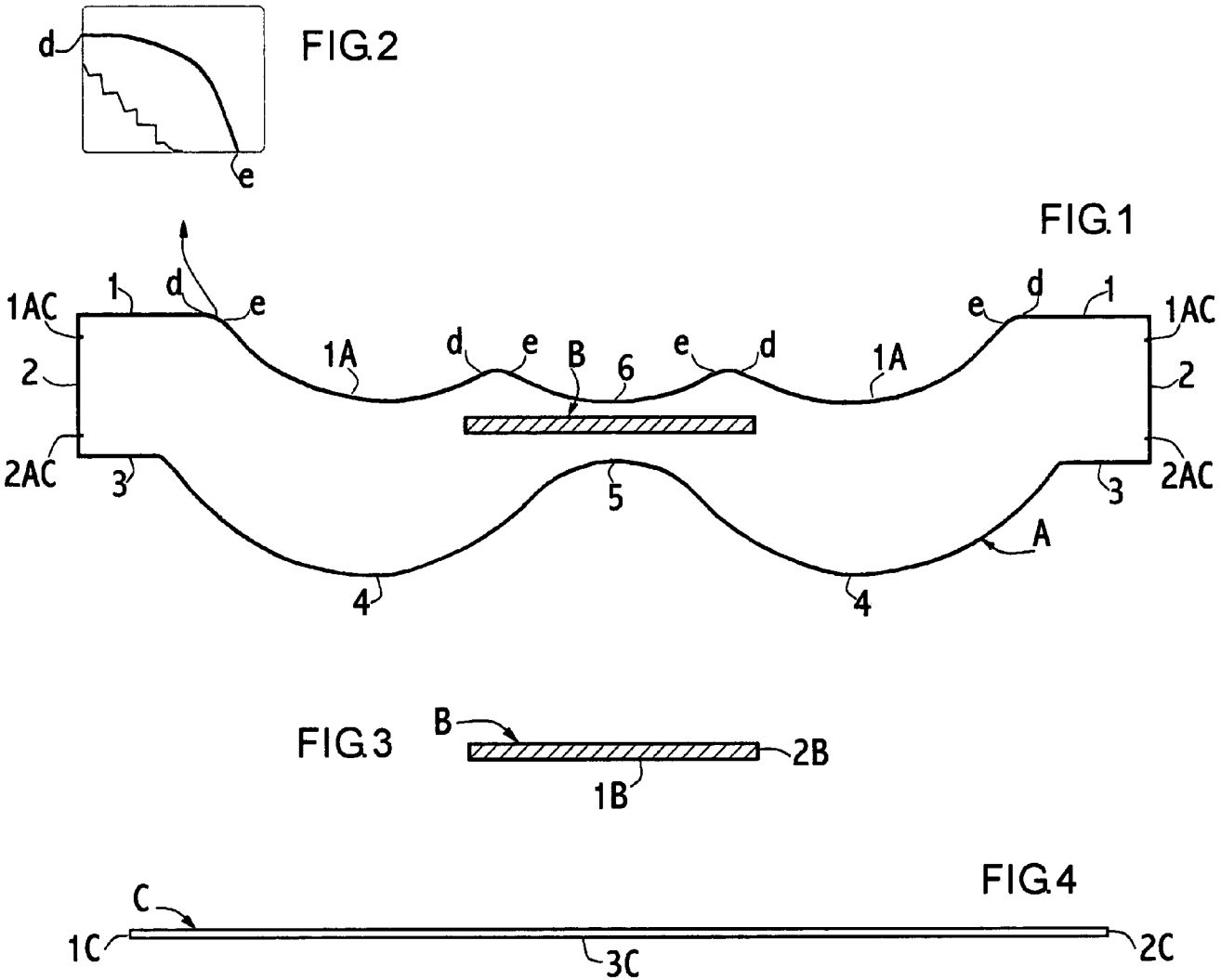
FIG. 1 is a front elevation view of the eyelash guard structured in accordance with principles of the present invention, a rear elevation view of the eyelash guard being identical to the front view.
FIG. 2 is an enlarged partial view in bracket of the FIG. 1.
FIG. 3 is a front elevation view of the metal element that is integrated in the middle part of the eyelash guard as shown in FIG. 1 of the drawings. A rear elevation view of the metal element being identical to the front view.
FIG. 4 is a front elevation view of the securing mechanism that is connected to the eyelash guard as shown in FIG. 1, FIGS. 5-9 of the drawings. A rear elevation view of the securing mechanism being identical to the front view.

The eyelash guard is a disposable device for use in the application of eye makeup according to an embodiment of the present invention. The invention will be more clearly understood with reference to the following detailed description when it read in conjunction with the drawings.

Referring to FIG. 1, FIGS. 5-7, the illustrated eyelash guard is comprised of three parts: the body A of the device, which provides a precise cover A1-4 to both sides of the area under the eyes; the pliable metal element B that molds over the nose bridge and works as a size adjuster; the fastening method such as the elastic ear loops C placed on both sides of the body of the device.

FIG. 1 shows a flat form of the device. FIGS. 6-7 show the eyelash guard in a modified form, fitted to the user's face. FIG. 5 shows the method of adjusting and the wearing of the device on the person's face. FIGS. 6-7 show the way this device works for the protection under the eye area for the application and removal of eye makeup. Eyelash guard underwent multiple testing. Any kind of size and design altering of any parts of the device to differentiate it from the original will affect it precise fit, comfort and performance.

Referring to FIG. 1, FIGS. 5-7 a body A of the device features a non perforated strip of material, horizontally elongated and symmetrical, which is curved to conform to the curvature of the human eye to fit concurrently under the eyelashes of the right and left eye. One unit can be cut from a rectangle approximately 185 mm long and 45 mm wide FIG. 1. Wherein the body A a substantial middle narrow portion 5-6 FIG. 1 that is 10 mm wide and one third of the width of said body A (1A-4), is adapted to contour the bridge of the nose and for the precise fit of the device under eyelashes, which forms with a downward arched upper edge 6 and the upward arched lower edge 5. Wherein the body A two symmetrical curved portions (1A-4) are adapted to shield both sides of the face, which forms by the substantial width expansion to 30 mm from the middle narrowing 5-6. The upper downward arched edge 1A of each curved portion, which meets and conforms to the roots of eyelashes, runs parallel to its lower edge 4, which rests upon the cheek bone, with the upper edge of each shape 1A shorter than its lower edge 4. The edges of the four top corners between points d and e FIGS. 1-2, that belong to the eye curves 1A FIGS. 1, 2, 5-7 are smoothed out. The FIG. 2 is an enlarged partial view of these corners. Wherein the body A each curved portion (1A-4) is finalized by the lateral straight angled edges 1, 2, 3 that rest at the edges of the temporal area, which are adapted for the connection points 1AC and 2AC of the fastening mechanism which surround the user's ears. The edge 2 is about 25 mm. The upper edge 1 of the lateral straight angled edges is longer than its lower edge 3. The body of the device is made from light, thin and flexible material, capable of catching and absorbing excess liquid or powdery types of eye makeup, to protect both the skin and previously applied facial makeup from eye makeup smudging.

The second part of the device is the narrow, pliable metal element B that is horizontally and symmetrically incorporated at the middle narrow portion 5-6 of said body A that is adapted to work together as a method of adjustment of the size and position of said device on the portion of the person's face under the eyes, for any size, position and shape of the eyes. The metal element B together with the middle narrow portion 5-6 of the device which sculpted by the fingers as a letter "U" which positioned to mold firmly over the nose bridge, allows the device A to be adjusted to fit precisely under eyelashes by upper edges A1 and to provide a perfect and smooth coverage of the portion of a person's face under the eyes by said curved portions 1A-4, with the maximum closeness of the edges of the device A1 to the roots of eyelashes without help of adhesive materials or other means FIGS. 5-7. The rectangle shape of the part B of the device is approximately 45 mm long 1B and 4 mm wide 2B and 0.1 mm thick FIG. 2.

Type of metal, thickness and its plasticity is crucial for the size adjuster B. The said metal element B, which is adapted as a size adjuster, is made from a type of pliable ductile metal that is able to hold firmly a letter "U" shape over the nose bridge when the device, under the moderate extending tension of the elastic ear loops C that secures said device on the person's face, ensures the precise and confirming fit of the device A by edges A1 to the curvature of the human eyes under eyelashes during eye makeup application.

The method of securing the device to the user's face is achieved thru the use of two identically thin, latex free elastic ear loops C FIGS. 5-7, 3C FIG. 4. The ending 1C of the elastic securing element is connected to the body A, on the side 2 of the device at the point 1AC. The ending 2C is connected to the point 2AC; accordingly, it is done to the other side of the device, as its right side is the mirror image of the left side. The top connection point 1AC is symmetrical to the bottom point 2AC.

Referring to FIGS. 5-7 a method of application of the eyelash guard and protection of the skin around the eyes from eye makeup smudges comprising: bending the body A of the device at the centerline over a small finger as a letter "U"; folding slightly at the middle so the endings 2 of the body A can meet; pressing both endings of the metal element B to make a firm loop; firmly positioning the middle narrow portion of the device 5-6 on the nose bridge; fastening the device on the person's face with elastic ear loops, adjusting the device on a user's face to ensure the perfect cover of the skin under the eyes from the eyelash growth line until the beginning of the cheekbone, bringing the edges of said device A1 exactly to the roots of eyelashes FIGS. 6-7, thereby freeing the hands to apply eye makeup on the eyelashes and the eyelids without smudging as shown and described herein.

From the foregoing, it will be apparent that the present invention provides a simple and inexpensive device that is a new and useful improvement over previous devices for use in the application of eye makeup and skin and eyelash protection.

What is claimed is:

1. A protective eye-makeup shield comprising:

a planar body extending along a longitudinal axis;

the planar body made up of two identical segments that are disposed symmetrically about a central line of symmetry, the central line of symmetry being orthogonal to a longitudinal axis;

the planar body having opposed top and bottom longitudinal edges connected by two parallel lateral edges;

the top edge comprising two concave top edges on opposing sides of the central line of symmetry; a medial concave edge disposed between the top concave edges; and a top end edge extending from each of the top concave edges parallel to the longitudinal axis and extending away from the central line of symmetry; the bottom edge comprising a convex edge disposed under each concave edge of the top edge; a bottom concave edge extending between the convex edges and beneath the medial concave edge of the top edge; and a bottom end edge extending from each of the convex edges parallel to the longitudinal axis and extending away from the central line of symmetry;

wherein the lateral edges are orthogonal to the top end edge;

a ductile strip of metal extending between the medial concave edge and the bottom concave edge along the longitudinal axis of the body; and an elastic ear loop attached to each lateral edge.

2. A method of using the protective eye-makeup shield of claim 1 comprising:

providing the shield of claim 1;

deforming the pliable metal strip to contour to the shape of the nose of the user;

placing the eye-makeup shield over the user's face with the pliable metal strip over the nose of the user such that the top concave edges are disposed above or below the users eye and the medial concave edge is disposed over the users nose;

arranging the elastic loops over the ears of the user to secure the make-up shield to the user's face; and applying make-up to the user's eye lash.

* * * * *